United States Patent [19]

Kane

[11] 3,953,208

[45] Apr. 27, 1976

[54] BOND-LIKE COPY PAPER BY COCKLING AFTER COATING OR IMAGING

[75] Inventor: Daniel E. Kane, San Jose, Calif.

[73] Assignee: SCM Corporation, New York, N.Y.

[22] Filed: Jan. 22, 1973

[21] Appl. No.: 325,843

[52] U.S. Cl. ..... 96/1.5; 96/1.8; 427/14; 427/121; 427/172; 427/276; 427/278; 427/288; 427/331; 427/382; 427/391

[51] Int. Cl.[2] ..... G03G 5/04; B05D 5/02

[58] Field of Search ..... 117/11, 64 R, 153, 34, 117/201; 162/112, 136, 137; 96/1.1, 1 R, 1.5, 1.8; 427/121, 276, 172, 288

[56] References Cited

UNITED STATES PATENTS

| | | | |
|---|---|---|---|
| 2,460,042 | 1/1949 | Stafford | 117/11 |
| 3,164,512 | 1/1965 | Dixson et al. | 117/11 |
| 3,193,403 | 7/1965 | Donelson | 117/11 |
| 3,272,643 | 9/1966 | Pasek et al. | 117/11 |
| 3,281,257 | 10/1966 | Rosen | 117/11 X |
| 3,347,702 | 10/1967 | Clancy | 117/201 |
| 3,360,393 | 12/1967 | Rhorer | 162/112 |
| 3,472,673 | 10/1969 | Sanders | 117/34 |
| 3,501,330 | 3/1970 | Cassiers et al. | 117/34 |
| 3,512,965 | 5/1970 | Matkan | 96/1 |
| 3,558,544 | 1/1971 | Cole et al. | 117/34 |
| 3,634,135 | 1/1972 | Akiyama et al. | 117/201 X |
| 3,639,640 | 2/1972 | Gager | 117/201 X |
| 3,652,271 | 3/1972 | Bornarth et al. | 117/201 X |
| 3,667,994 | 6/1972 | Ward | 117/11 X |
| 3,674,534 | 7/1972 | Connair | 117/34 |
| 3,681,071 | 8/1972 | Donald | 96/1.8 |
| 3,799,827 | 3/1974 | Takimoto et al. | 96/1.5 X |

FOREIGN PATENTS OR APPLICATIONS

| | | | |
|---|---|---|---|
| 7,102,220 | 8/1971 | Netherlands | 96/1.5 |
| 767,602 | 2/1957 | United Kingdom | 117/11 |

*Primary Examiner*—Ralph Husack
*Assistant Examiner*—Stuart D. Frenkel
*Attorney, Agent, or Firm*—Armand G. Guibert; Milton M. Wolson

[57] ABSTRACT

An electrophotographic paper based on a flat surface bond type paper is given a photoconductive coating to one side of the paper and is cockled afterward. This "post" cockling process can be done on a suitable web roll during production of the coated electrophotographic stock, or an electrographic or electrophotographic copy sheet can be cockled or embossed after imaging, toning and fixing by a conventional electrophotographic apparatus.

7 Claims, 3 Drawing Figures

BOND-LIKE COPY PAPER BY COCKLING AFTER COATING OR IMAGING

BACKGROUND OF THE INVENTION

This invention relates generally to an improved electrophotographic paper and more particularly to a bondlike copy paper which despite being coated has the general appearance, feel and handle of ordinary uncoated cockled bond paper.

Moreover, this invention relates to texturing of plain bond paper such as those in Xerox (TM) type machines, and also electrographic papers.

Known electrophotographic coated paper is comprised of a conductive base or substrate, ordinarily a treated paper, and a photoconductive layer bonded to and supported by the substrate. The photoconductive layer comprises a resinous substance having dispersed therein finely divided particles of photoconductive material, such as zinc oxide. Such papers are suitable for imaging in accordance with the well-known photoelectrostatic copying process and may be developed by using a pigmented thermoplastic powder that is attracted to the image areas and fixed to the imaging surface of the sheet of paper by heating, or developed by use of liquid toners in known fashion.

In general, conventional photoelectrostatic copy sheets do not look, feel, and handle like ordinary bond paper and for this reason have not enjoyed more widespread commercial success.

For instance, known photoelectrostatic copy papers of zinc oxide type have a smooth flat imaging surface tending to be glossy and thus reflect illumination in a mirrorlike fashion to produce glare. Such known copy papers are described and discussed in "Xerography and Related Processes," edited by John H. Dessauer and Harold E. Clark, The Focal Press, London and New York, 1965; also in Young, C. J. and Grieg, H. G., "RCA Review," 15, page 471 (1954). These known copy papers produce images that are somewhat difficult to read in certain orientations with respect to the source of light. Further, this smooth surface is also a poor medium on which to write with pen or pencil.

Known copy sheets suffer from a further disadvantage in that as a result of employing a dense, low bulk, supercalendered base paper which enhances the smoothness of the imaging surface, the copy sheets tend to be heavier than ordinary paper and feel limp.

Other potential base papers are those which do not have a flat surface, but are either cockled or embossed, presenting a rough, puckered appearance. Those found that such base papers give an uneven zinc oxide coating which leads to background toning problems. Further, in the preparation of conventional copy sheets, care has usually been taken to insure against producing a rough imaging surface sine it has heretofore been considered important to have maximum smoothness of this surface in order to avoid mechanical entrapment of the developer powder in the background or nonimaged areas of the sheet.

According to my invention the supporting base paper may or may not be pretreated for solvent holdout (and dispersant holdout, if intended for use with a liquid developer) and to provide conductivity. Of course, if the solvent holdout is not present, a certain amount of penetration by the photoconductive mixture into the paper is allowed which, in itself, helps improve the overall feel of the paper and makes the zinc oxide coating conform more closely to the fine texture of the paper. Whether the base paper chosen is pretreated or not, my process of cockling the electrophotographic coated paper after applying a suitable photoconductive coating will render the desired appearance and feel of typing bond paper, not previously achieved by other means. This texture may even be achieved by cockling or embossing single sheets after exposing and developing the finished electrophotographic paper.

In a conventional method of preparing copy sheets of the above-mentioned types, a resin material is dissolved in an organic solvent medium, principally toluene. Photoconductive particles of zinc oxide are then mixed with this liquid medium until a paintlike consistency is achieved. The mixture is then applied as a coating to a paper base and the solvent medium is evaporated, leaving a thin photoconductive layer bonded to the support surface of the base paper. The invention will demonstrate how my copy paper can give a better bondlike appearance by using applicable texturing techniques -- cockling by drying or embossing or the like -- after coating.

SUMMARY OF THE INVENTION

Accordingly, it is the general object of this invention to provide an improved electrophotographic coated paper -- prepared in accordance with organic solvent techniques -- which looks, feels, and handles like ordinary uncoated writing or bond paper of high quality.

It is another object of the present invention by proper selection of base paper to provide an improved electrophotographic coated paper which is easy to read (being relatively glare free), readily receives pencil markings or the like, and has in many aspects the qualities of bond paper.

It is a further object of the present invention to provide a lightweight bondlike zinc oxide electrophotographic coated paper, prepared in accordance with organic solvent coating techniques, and appearing to have a cockled fiber type of imaging surface rougher than the surfaces of conventional imaging papers which will not mechanically entrap developer powder in background areas.

Still another object of the present invention is to utilize a paper with a flat support surface suitable for any electrophotographic process now well known in the art, which paper can then be cockled by controlled tension drying, embossed, or the like, either before or after development of an image.

BRIEF DESCRIPTION OF THE DRAWING

Other objects and advantages of the invention will appear from the following description of the preferred embodiments thereof shown in the accompanying drawings, wherein.

GENERAL DESCRIPTION

Figure 2:
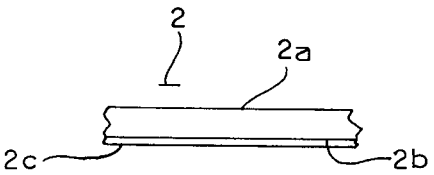
FIG. 2 illustrates an appropriate web used in the process shown in FIG. 1.

An acceptable imaging surface **2*b* derived from a web 2** will have a flat (non-puckered) support surface 2*b* as heretofore considered necessary for high quality copies. I discovered that one can have a high quality bond paper effect by postcockling or embossing such suitable paper 2. For purposes of this invention, I have found that Kimberly Bond manufactured by Kimberly Clark, Neenah, Wisconsin; Stock 06-0678C, a paper manufactured by Allied, Kalamazoo, Michigan; and Coronastat (TM) paper, a conventional zinc oxide copy paper made by SCM, Business Equipment Division, Phoenixville, Pa. and similar to the well-known Electrofax (TM) paper developed by RCA, have all given favorable results in the final application. It should be noted that these above-mentioned materials in the form of a paper (or "web") roll 24 serve merely to illustrate and it is not the intention that this invention be confined to them, since other suitable papers may be used as substitutes with equally favorable results.

In the invention, where paper roll 24 preferably is not pretreated with any solvent holdout or barrier on an imaging surface 2*b*, which is to receive zinc oxide photoconductive mixture 7, an aqueous conductive coating holdout material 15 is placed on base surface 2*a* of paper 2 after application of zinc oxide photoconductive mixture 7. Material 15 serves not only as a conductive backing, but may also serve as a holdout for toner dispersant where a liquid developer is used, the dispersant liquid generally being a petroleum product and the holdout or barrier material then being necessarily oleophobic. Because of the sizing used in typical high quality bond paper 2, a certain degree of penetration of electrophotographic coating 7 takes place when applied by a pickup roll 5 or by any other conventional technique known in the art. This penetration, together with the natural texture of paper 2, gives a desired level of microtexture to the finished paper on roll 21.

Paper 2 is dried at drying station 11 by radiation or any other known method after application of photoconductive mixture 7. For purposes of this invention, aqueous cockling solution 15, used for the postcockling, is applied immediately after drying station 11 by some conventional equipment, such as an applicator roll 14 (it could also be applied later in a separate operation, of course). After the application of cockling solution 15, paper 2 is then dried at station 22, but now under sufficiently low tension so that puckering (cockling) can develop and the macrotexture, that is, large scale surface irregularities such as the pucker, results upon drying. It will be recognized at this time that applying to such paper 2 a coating 15 made of an aqueous conductive holdout mixture in the case of plain bond paper (or pure water in the case of pretreated paper) with the idea of changing the macrofinish of the paper after applying photoconductive coating 7 is contrary to the normal concept of electrophotographic or electrographic paper coating. I have found that it is possible by the techniques described below to produce an electrophotographic coating which is of reasonably uniform thickness over the entire surface 2*b* of paper 2 and yields images of satisfactory quality without excessive background and further gives the finished product of web 2 an appearance of high quality cockled bond paper.

Figure 3:
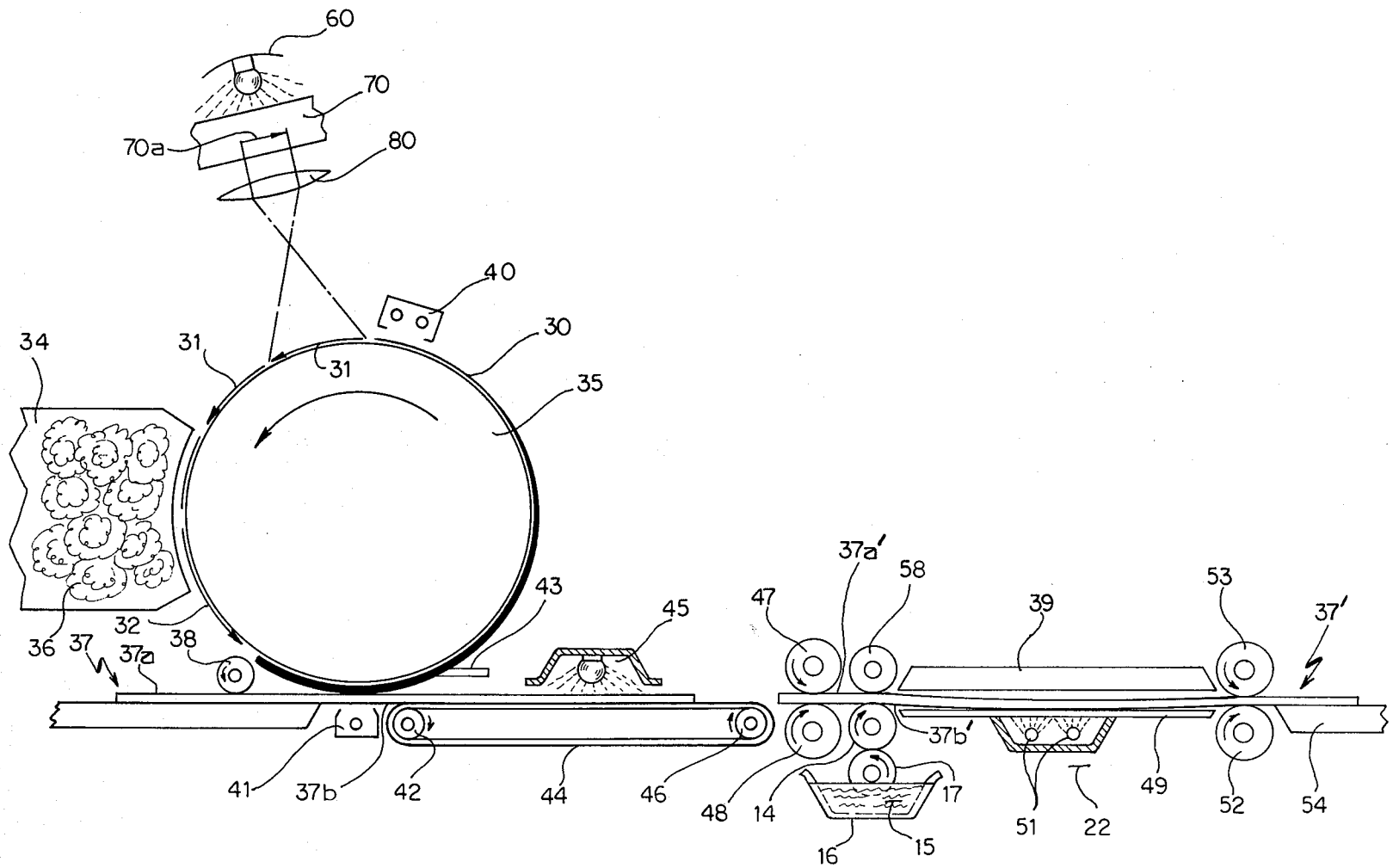
FIG. 3 is a schematic drawing of a copy machine in which a cockling operation is performed to each sheet after the developing and fusing of an image thereon.

As a result of my discoveries, I provide a bondlike zinc oxide paper roll 21 which is cockled preferably by air drying or, in the alternative, by embossing a nonpretreated or pretreated "flat" imaging surface plain bond paper 2 or any of the other above-mentioned papers 2. This cockling of paper 2 is a process performed "post" coating -- i.e., after application of photoconductive coating 7. In the preferred embodiment, application of cockling mixture 15 is done immediately after the photoconductive coating process is performed. However, postcockling may be done after paper roll 21 has been converted into a finished copy sheet product and such copy sheets have been imaged, developed and even fixed, as shown in FIG. 3 and as will be discussed later. The result of either method used for postcockling will be the same -- that is, each yields a copy sheet that greatly resembles high quality cockled bond paper.

DESCRIPTION OF THE PREFERRED EMBODIMENTS

Figure 1:
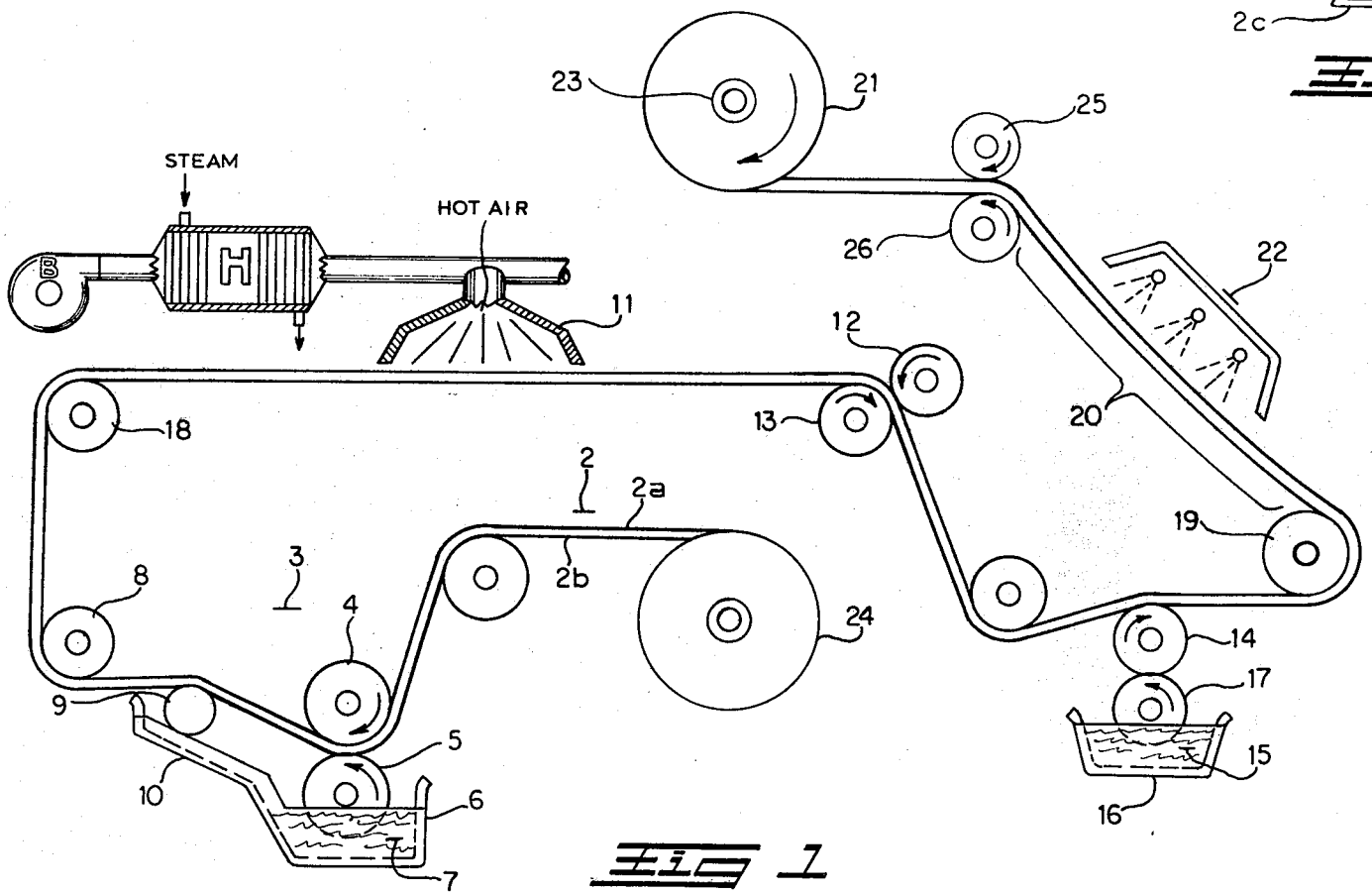
FIG. 1 is a schematic drawing of a web photoconductive coating process according to my invention, in which a technique for cockling the web after the photoconductive coating process is incorporated.

The invention is disclosed in further detail by means of FIGS. 1, 2, and 3 which are provided for purposes of illustration only. It will be understood by those skilled in the art that modifications either in relative proportions of binder materials, apparatuses, methods used, or operating conditions can be made within the disclosure of this invention without departing from the spirit and scope thereof.

Referring to FIG. 1, paper 2 may be fed to an appropriate coating apparatus 3. FIG. 1 shows a backup roll 4 used to drive paper 2 smoothly as it comes in the proximity of pickup roll 5, which delivers photoconductive coating mixture 7 contained in a mixture tank 6 and applies the coating mixture 7 to imaging surface 2*b* only. In this embodiment, a zinc oxide photoconductive coating mixture 7 is used at a rate, say, of 20 lbs. per 3000 sq. ft. This coating weight is not critical and may be adjusted to accommodate various types of paper. Photoconductive coating mixture 7 applied to paper 2 is prepared in accordance with standard techniques, using resin and zinc oxide (suitably sensitized, as is known) blended together in an organic solvent medium and applied to surface 2*b* of paper 2 to form a layer 2*c*, using applicator roll 5, as described above, or any other conventional coating equipment. Such methods of application are found in "Pigmented Coating Processes for Paper and Bond, A Project of the Coating Committee, G. L. Booth, Chairman, Monograph Subcommittee, Tappi Monograph Series No. 28," copyrighted 1964 by Technical Association of the Pulp and Paper Industry, 360 Lexington Avenue, New York, New York 10017 and in "Methods of an Apparatus for Coating Paper," by D. R. MacDonald, U.S. Pat. No. 2,135,406 issued Nov. 1, 1938. It should be noted at this time that paper 2 may or may not be pretreated and the normal surface sizing of a typical paper 2 will allow only a sufficient amount of penetration of zinc oxide coating mixture 7 so that it will conform closely to the fine texture of paper 2. This penetration and conformance contribute to the bondlike appearance and feel of paper 2.

The layer 2*c* of coating mixture 7 applied to imaging surface 2*b* then passes over a wire wound metering rod 9 which cuts off excess coating 7 and leaves an initially smooth uniform surface for layer 2*c* on paper 2. Any excess coating mixture 7 would fall on mixture tank lip 10, allowing mixture 7 to return to mixture tank 6. It should be noted that metering rod 9 is one of many coating thickness control techniques used in the art and serves only as illustrative of one preferred embodiment of the invention. After the coating process, paper 2 must be dried. Accordingly, a couple of guide rollers 8 and 18, together with a pair of tension control rollers 12 and 13, maintain tension on paper 2 relative to supply reel 24 as paper 2 passes a drying station 11, which dries coating 7 either by hot air circulation or any other well-known drying technique used in the art.

In light of the general description, after receiving coating mixture 7 and then being dried at station 11, paper 2 passes a cockling station which employs an applicator roll 14 for applying an aqueous solution 15 and a pickup roll 17 to bring a suitable amount of solution 15 out of a solution tank 16 for postcockling of paper 2. For my purposes, applicator roll 14 will merely skim base surface 2*a* of paper 2, applying solution 15 as it rotates together with pickup roll 17. As stated previously, paper 2 may or may not be pretreated before going through the photoconductive coating process. If it is pretreated, then aqueous solution 15 would be plain water; if it is not, then aqueous solution 15 would be some suitable conductive coating with a holdout additive, i.e., a resin. One such solution 15 is the Merck Calgon Conductive Polymer, manufactured by Merck Calgon Chemical Division, Merck & Co., Rahway, New Jersey. This invention is not restricted to this solution brand, however, there being others well known in the art which would be just as satisfactory. Once base surface 2*a* of paper 2 has received this solution 15, it must be dried under low tension in order to produce the cockling effect. Therefore, paper 2 travels around past a drying station 22 which can perform its function by infrared radiation since the solution here is aqueous. As an alternative, if preferred, station 22 may apply a portion of the hot air produced for use at station 11 by the heating and blowing elements shown but not numbered in FIG. 1. Since it is important to keep web (paper) 2 under low tension while drying for the cockling effect to be optimum, a pair of tension control rollers 25 and 26 cooperating with the abovementioned rollers 12 and 13 will control the tension in paper 2 such that it has a slack portion 20 at drying station 22 between a guide roller 19 and the rollers 25,26. The amount of slack in portion 20 is controlled to provide a light tension sufficient to allow puckering, but not so low as to allow gross deformation, such as curling. A reel 23 is provided for paper take-up on roll 21, the speed of reel 23 being controlled relative to that of tension control rollers 25,26 by varying the power to the drive for reel 23, a takeup motor, say (not shown, but known).

As stated before, different types of paper stock can be used for this purpose with some minor alterations in application. Therefore, to exemplify, I will give three examples of suitable paper stock and the application used for each.

EXAMPLE I

Plain bond paper (such as Kimberly Bond)

| | |
|---|---|
| Step 1: | Apply zinc oxide coating mixture to one side |
| Step 2: | Dry under high tension, |
| Step 3: | Apply conductive/holdout coating to the other side, and either |
| Step 4: | Dry under reduced tension; or |
| Step 4': | Dry under high tension, and |
| Step 5': | Emboss |

EXAMPLE II

Allied paper (rough, surface-barrier at opposite side, pretreated)

| | |
|---|---|
| Step 1: | Apply zinc oxide coating mixture to one side |
| Step 2: | Dry under high tension, and either |

-continued

| | |
|---|---|
| Step 3: | Apply water to the other side, and |
| Step 4: | Dry under reduced tension, or |
| Step 3': | Emboss (no application of water) |

EXAMPLE III

Conventional ZnO coated paper (SCM Coronastat (TM) paper formed in n steps and using a flat smooth surface base paper)

| | |
|---|---|
| Step (n+1): | Apply water to the side opposite the ZnO coating and |
| Step (n+2): | Dry under reduced tension, or |
| Step (n+1)': | Emboss (no application of water). |

Now, referring to FIG. 3, there is shown a method of postcockling a copy sheet after it has been imaged, toned, and fixed by a conventional electrophotographic apparatus using an appropriate dry toning technique such as the one described on page 129 in "Electrophotography," R. M. Schaffert, The Focal Press, London and New York. Although a dry-toning embodiment is shown in FIG. 3, it will be evident to those skilled in the art that other toning techniques such as liquid toning might also be used.

The electrophotographic process deposits a latent image 31 on an overcoated photoconductor element 30 formed on the surface of a drum 35, made of selenium, say. Prior to formation of latent image 31, element 30 is given a uniform surface charge by subjecting it to a discharge from a corona source 40 (well known in the art). Formation of latent image 31 is accomplished by projecting an image 70*a* by means of a light source 60 and projecting lens 80 (such apparatuses are well known in the art, as can be seen from the previously mentioned text by Schaffert).

Once latent image 31 is deposited upon photoconductive element 30, rotation of drum 35 will being latent image 31 into contact with toner particles 36 pulling them by electrostatic attraction to create a toned image 32. Further rotation of drum 35 will bring toned image 32 into contact with a surface 37*a* of a copy sheet 37. A suitable copy sheet 37 may be plain flat surface bond having the properties of high quality bond paper. As sheet 37 moves along with drum 35, toned image 32 is transferred to sheet 37 by means of a transfer corona source 41 which sprays charges opposite in polarity to that of toner particles 36 onto the base 37*b* thus pulling toner particles 36 from photoconductor element 30 towards surface 37*a* of sheet 37. After toner transfer, sheet 37 will travel past a fusing station 45 on a conveyor belt 44. Toned image 32 is there fused by some suitable means, such as infrared radiation or the like, after which sheet 37 is pulled along by a pair of rollers 47 and 48 to the next station, the cockling process.

The cockling process is then done in like manner as described in the embodiment relating to FIG. 1 insofar as the procedure for application and drying of the cockling solution is similar in both embodiments. At the entrance to the cockling station, each sheet (exemplified by 37' in FIG. 3) is seized by a pair of drive rolls 47,48 and then immediately passed to another pair of rolls 14 and 48. The roll 14 is the same as the applicator roll used in FIG. 1, transferring solution 15 from the pickup roll 17, as previously explained. The backup roll 58 is included to ensure contact between the paper and the moist surface of applicator roll 14. Note that roll 58 is on a fixed axis to prevent contact with applicator roll 14 in the absence of a sheet 37 as otherwise undesired transfer of water to surface 37*a'* of sheet 37 would occur intermittently and possibly result in even drying. As one minor difference in this second embodiment, the drying device 22 is modified slightly to allow for operation upon cut sheet 37' oriented horizontally. Accordingly, a guide member 39 may be included to limit curling of the paper and resultant hindrance of uniform drying. Further, a number of parallel guide rods 49 may also be applied over the opening of the drying device 22 to keep the moistened paper from direct contact with the heated elements 51 of drying device 22. After the cockling stage, the sheet 37' is picked up by a pair of exit drive rollers 52 and 53 which push it to delivery platform 54 in customary fashion. Because of the short length of the cut sheets, in this embodiment no tension is applied to the sheets and the amount of cockling is determined by the kind of paper stock and the kind and amount of cockling solution used. The intensity and time of drying must be adjusted according to these three variables. It should be noted that the kind of paper implicitly contains yet another variable, namely the lot-to-lot variation, as is well known in the paper industry. As an example of suitable drying conditions, Hammermill "Xerocopy" (TM of Hammermill Paper Co., Eire, Pennsylvania) was coated in the laboratory with water using a No. 13 wire wound rod as a metering device and a suitable cockling achieved after drying with an electrically heated air blower for about 5 seconds. More efficient means of heating could be applied to shorten drying time in actual practice, of course. In this respect, however, because of speed requrements, embossing -- which is potentially faster -- would be the texturing technique most likely to be commercially suitable for the cut sheet application. The embossing referred to previously may be performed by passing the coated web (or sheet, in the case where the texturing is performed on an electrophotographic copy sheet subsequent to imaging or even subsequent to developing or fixing the image on the sheet) through a pair of adjacently located embossing rolls (not shown in a specific figure, but could be any of the roll pairs in FIGS. 1 and 3 located subsequent to the drying station 11 of the former or the station having the imaging elements 60, 80 of the latter, as is evident to those skilled in the art). Preferably, the embossing rolls comprise one roll with a pattern of protuberances and another roll with a resilient surface adjacent to the protuberances.

In summary, I have described herein an apparatus and methods for postcockling of conventional photoconductive copy papers for the improvement of the appearance and feel of such paper and for giving a high quality bondlike appearance while at the same time eliminating any toner mechanical entrapments or background problems created by rough imaging surfaces found in bond paper. It should be understood that the apparatus used for postcockling may be placed so as to be effective on the roll stock immediately after the photoconductive coating and drying process (as described in the first embodiment); or it may be placed so as to be effective on a flat surface copy sheet after the imaging, toning and even fixing process is done. If embossing of the copy sheet is performed, the developed image on the copy sheet must be fused first. If post cockling is chosen, however, it is envisioned that fixing of the image could be done before or after cockling.

Therefore, while a particular embodiment of the invention has been shown and described, modifications such as the abovementioned, or variations in solution mixtures or application methods are envisioned, and it is intended in the claims to cover all such modifications which fall within the spirit and scope of the invention.

What is claimed is:

1. In the process of manufacturing an electrographic layer by the steps of applying a solvent based photoconductive coating to one side of a web and drying the coated web, the improvement comprising the steps of:

a. choosing a flat bond paper for said web as a preliminary step, and b. applying a macrotexture to said bond paper by cockling the surface thereof subsequent to said drying step through the additional steps of b1) moistening said coated web with an aqueous solution, and b2) drying the moistened web under a controlled light tension to achieve said cockling.

2. The process defined in claim 1, wherein said step of moistening the coated web utilizes a solution for applying a further coating to said web said further coating adapting said photoconductively coated web for improved performance in electrophotographic processing.

3. The process defined in claim 2, wherein said solution applies a conductive coating to a side of said web opposite to the side on which said photoconductive coating is applied.

4. The process defined in claim 2, wherein said photoconductively coated web is adaptable to development with a toner dispersed in a liquid comprising a petroleum product and said solution applies a barrier coating to the coated web, said barrier coating comprising an oleophobic substance.

5. The process defined in claim 1, wherein said paper chosen in said preliminary step has been pretreated with a special coating, said special coating adapting the photoconductively coated web for improved performance in electrophotographic processing, and said step of moistening the coated web utilizes water alone.

6. The process defined in claim 5, wherein the pretreatment consists in applying a conductive coating to a side of said web opposite to the side on which said photoconductive coating is applied.

7. The process defined in claim 5, wherein said photoconductively coated web is adaptable to development with a toner dispersed in a liquid comprising a petroleum product and the pretreatment consists in applying a barrier coating to the coated web, said barrier coating comprising an oleophobic substance.

* * * * *